US010005097B2

(12) United States Patent
Tanley et al.

(10) Patent No.: US 10,005,097 B2
(45) Date of Patent: Jun. 26, 2018

(54) DIE FOR COATING SUSPENSIONS WITH FLOW OBSTRUCTION DEVICE AND METHOD OF USE

(71) Applicant: 3M INNOVATIVE PROPERTIES COMPANY, St. Paul, MN (US)

(72) Inventors: Chris J. Tanley, Stillwater, MN (US); Lori T. Holmes, Woodbury, MN (US); Michael J. Tichy, Henning, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days. days.

(21) Appl. No.: 15/524,772

(22) PCT Filed: Nov. 5, 2015

(86) PCT No.: PCT/US2015/059302
§ 371 (c)(1),
(2) Date: May 5, 2017

(87) PCT Pub. No.: WO2016/073761
PCT Pub. Date: May 12, 2016

(65) Prior Publication Data

US 2017/0333937 A1 Nov. 23, 2017

Related U.S. Application Data

(60) Provisional application No. 62/075,508, filed on Nov. 5, 2014.

(51) Int. Cl.
*B05C 5/02* (2006.01)
*B05C 11/10* (2006.01)

(52) U.S. Cl.
CPC ..... *B05C 5/0254* (2013.01); *B05C 11/1002* (2013.01)

(58) Field of Classification Search
None
See application file for complete search history.

(56) References Cited

U.S. PATENT DOCUMENTS 3,272,231 A 9/1966 Livingston
4,293,517 A 10/1981 Knox
(Continued)

FOREIGN PATENT DOCUMENTS

DE 4010262 10/1991
DE 102013219628 4/2014
(Continued)

OTHER PUBLICATIONS

International Search report on PCT International Application No. PCT/US2015/059302 dated Jan. 2, 2016, 6 pages.

*Primary Examiner* — Jethro M Pence

(57) ABSTRACT

A center-fed single cavity slot die (100) for coating particulate suspensions without creating the coating defect known as center banding. The die has a flow obstruction device (109) located in the die cavity (105) in a position such that the flow obstruction device blocks undisturbed straight-line flow of coating composition from the feed inlet to the die coating slot. Also, a coating process that employs the disclosed coating die. Types, shapes, sizes, and compositions of particles that may be used, and viscoities and particle concentrations of the coating composition which may be used.

26 Claims, 2 Drawing Sheets

(56) References Cited

U.S. PATENT DOCUMENTS

| | | | | |
|---|---|---|---|---|
| 4,411,614 | A | 10/1983 | Feathers | |
| 4,989,456 | A | 2/1991 | Stupecky | |
| 5,529,084 | A | 6/1996 | Mutsakis | |
| 6,367,776 | B1 | 4/2002 | Lippert | |
| 6,722,211 | B1 | 4/2004 | Ciobanu | |
| 6,736,291 | B1 * | 5/2004 | Mimura | B05C 11/00 222/129 |
| 7,897,081 | B2 | 3/2011 | Ausen | |
| 2003/0157252 | A1 * | 8/2003 | Tokimasa | B05C 5/0254 427/355 |
| 2003/0175430 | A1 * | 9/2003 | Tomaru | B05C 5/0254 427/356 |
| 2004/0247794 | A1 * | 12/2004 | Tokimasa | B05C 5/0254 427/421.1 |
| 2005/0056214 | A1 * | 3/2005 | Tomaru | B05C 5/0254 118/411 |
| 2006/0060135 | A1 * | 3/2006 | Rankin, Jr. | B05C 5/025 118/412 |
| 2006/0068114 | A1 * | 3/2006 | Hasegawa | B05C 5/0254 427/356 |
| 2014/0000511 | A1 | 1/2014 | Wang | |
| 2014/0000517 | A1 | 1/2014 | Ishii | |

FOREIGN PATENT DOCUMENTS

| | | | |
|---|---|---|---|
| EP | 1834116 | B1 | 10/2013 |
| JP | 2003001172 | | 1/2003 |

* cited by examiner

DIE FOR COATING SUSPENSIONS WITH FLOW OBSTRUCTION DEVICE AND METHOD OF USE

CROSS REFERENCE TO RELATED APPLICATIONS

This application is a national stage filing under 35 U.S.C. 371 of PCT/US2015/059302, filed Nov. 5, 2015, which claims the benefit of Provisional Application No. 62/075508, filed Nov. 5, 2014, the disclosure of which is incorporated by reference in its/their entirety herein.

FIELD

The present invention relates to a die and method for coating particulate suspensions.

BACKGROUND

Single cavity slot dies are often used to coat compositions onto substrates because of their simplicity and ease of use. Center-fed single cavity slot dies are particularly simple in design and operation. However, when the coating composition to be applied contains suspended particulate material, such as nanoparticles, conventional powders, or microspheres or beads, difficulties can arise and coating defects can be introduced.

One such defect is center banding. When coating a substrate web, center banding manifests as a band of higher concentration of the particulate ingredient of the coating in a band down the center of the web, coincident with the center of the coating die. It is believed that center banding occurs because a center fed die has a higher velocity along the portion of the die that could be considered as a linear extension of the feed conduit. In other words, as the coating composition spreads out to fill the entire width of the die, its velocity in the machine direction is lower everywhere except for a channel down the centerline that coincides with the location of the center-fed die's feed inlet. Coating composition components that flow directly down this region along and near the centerline tend to not experience any sideward motion, and continue to move downstream at similar velocity to that they had while still in the feed inlet conduit, or at least at a velocity closer to the original feed inlet conduit velocity than that of composition portions farther to either side of the die.

This higher velocity near the centerline of the die is believed to cause an elevated concentration of particulates at the center of the coated substrate.

In some instances, variations in particulate concentration, bare streaks, or other defects may lead to undesired variations in optical clarity, appearance, or other parameters across the resultant coated article. For instance, coated layers comprising polymeric matrices with particles incorporated therein are used as haze or diffusion layers in some optical film applications. Variations in particle concentration in such products may be visible as undesired and disruptive variations in brightness, color, etc. of a device such as a digital display made with such products.

Many attempts have been made to eliminate center banding when center-fed single cavity slot dies are used for coating compositions that contain suspended particulates. One approach has been to redesign the shape of the die's cavity. But this approach has seen limited effect, and has the disadvantage that a die cavity must be redesigned specifically for each coating composition and intended coating speed. Thus, this approach lacks versatility.

Another approach has been to design for low die inlet flow velocities, but this approach has an inherent disadvantage in that it limits the potential coating speed of the coater. Other approaches relating to the formulation of the coating composition itself are also of limited applicability.

There remains a need for a versatile, simple, and cost-effective solution to avoid center banding when coating particulate-laden coating compositions with a center-fed single cavity slot die.

SUMMARY

The present invention provides a slot die and method for coating liquid suspensions of particulates.

In one aspect, the invention is a center-fed single cavity slot die for coating particulate suspensions, sometimes referred to herein as coating compositions. The die has a top die portion and a bottom die portion. The top die portion and bottom die portion are assembled together using some means for spacing to provide the final dimensions of the die cavity and the die coating slot. In some embodiments, this means for spacing can be one or more shims. A feed inlet is provided at the center, with respect to the die width, of the bottom die portion. A flow obstruction device is provided. The flow obstruction device has a support member and a deflector member. The support member is affixed to the bottom die portion, within the die cavity. The point at which the support member is affixed is centered with respect to the width of the die. The deflector member is affixed to the support member on the side facing the feed inlet, and is also centered with respect to the width of the die. The deflector member may be planar or non-planar, and has a rectangular profile, optionally with rounded corners, in a plane orthogonal to the feed inlet flow direction. The rectangular profile has a height that is comparable to the height of the die cavity at the location at which the flow obstruction device is affixed to the bottom die portion, the rectangular profile height being smaller than the die cavity height by only enough to provide clearance and avoid interference when the die is assembled. The width of the rectangular profile is comparable to the diameter of the feed inlet, being from about ⅔ the diameter of the feed inlet to about 4/3 the diameter of the feed inlet.

In another aspect, the present invention provides a coating process that includes the steps of: providing a coating composition or liquid suspension comprising solvent, polymer soluble in that solvent, and a particulate component suspended in the dissolved polymer solution but insoluble in that solvent; feeding that coating composition to a single cavity slot die having the flow obstruction device described above; and applying the coating solution to a substrate. The particulate material can be in the form of beads, or nanoparticles, or any other particulates, including particulates of regular or irregular shape.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not to scale. Like numbers used in the figures refer to like components; however, the use of a number to refer to a component in a given figure is not intended to limit the component in another figure labeled with the same number.

DETAILED DESCRIPTION OF ILLUSTRATIVE EMBODIMENTS

Figure 1:
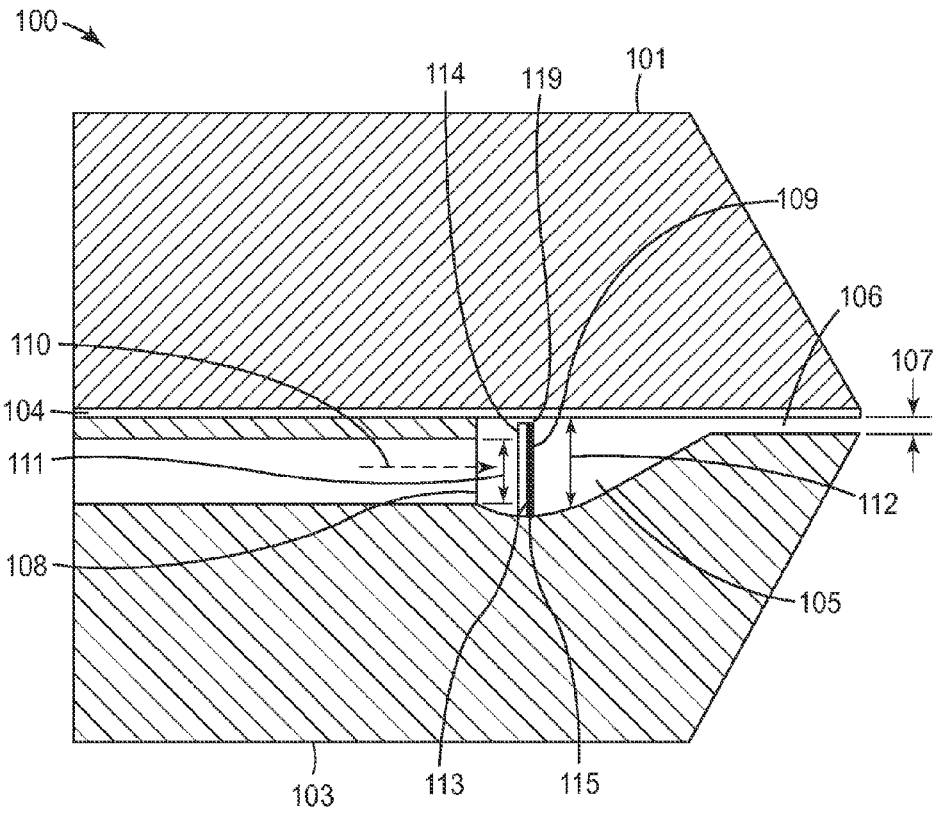
FIG. 1 is a schematic cut-away side view of a center-fed single cavity slot die having a flow obstruction device.

In the following description, reference is made to the accompanying drawings that forms a part hereof and which are shown by way of illustration. It is to be understood that other embodiments are contemplated and may be made without departing from the scope or spirit of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

In coating methods such as slide coating, slot coating, and curtain coating, cavity-slot dies are frequently employed. One of the simplest kinds of cavity-slot die is the center-fed single cavity slot die. These coating methods are common methods for making thin film coatings on flexible substrates such as polymeric films. The methods excel in distributing coating compositions uniformly in the transverse or cross-web direction, in other words, across the width of the coating die.

Die geometry must be carefully designed and die machining must be precise so that the desired uniformity at the exit of the slot die is achieved. Flow in a single cavity slot die should be laminar, and the coating composition can range from mildly shear-thinning to somewhat viscoelastic. The resultant coating uniformity is sensitive to a number of factors, including cavity shape and volume, slot length and height, inlet flow velocity, coating composition properties, and die width. Once all such parameters and their interactions have been analyzed and an optimized die for a given application has been designed and built, a change to the process can raise performance issues.

In many applications in the area of optical films, a particulate-laden coating is applied in order to provide optical diffusion for purposes such as anti-glaring, matte look, defect hiding, and bulb hiding. It is very typical for the type of particulate material to vary from product to product, even within closely similar families of products. Nanoparticles, conventional powders, microspheres, and beads are all frequently used. The nanoparticles and conventional powders may be irregular in shape. Beads may be spherical or oblong in shape. It is also typical for the size and size distribution of the particles to vary in a given coating. It is also typical for the concentration of the particles to vary.

A frequently observed problem when using center-fed single cavity slot die coating methods with coating compositions that contain particulate materials is center banding. Center banding is the presence, in the finished dried coating, of a band along the machine direction of the coated substrate web, at a location that coincides with the centerline, with respect to the width, of the coating die, such band containing a higher concentration of the particles in the dried finished coating. Center banding results in different optical properties for the center band, and it thus a significant defect when coating films for optical purposes, and thus must be avoided. It is nearly impossible to optimize a center-fed single cavity slot die to entirely eliminate center banding, and even when it can be so optimized, changing anything about the process typically results in the return of the center band defect.

We have surprisingly discovered that center banding can be eliminated entirely, and for a wide variety of coating compositions, when coating a polymer solution laden with suspended particulate material with a center-fed single cavity slot die, by providing the die cavity with a flow obstruction device meeting certain design requirements and placing the flow obstruction device just downstream from the center-feed inlet, so that it obstructs the direct straight-line, and near-straight-line, paths from feed inlet to the center of the width of the die slot. Another surprising discovery is that if the flow obstruction device is designed and placed according to certain rules, other defects one might anticipate would be introduced by disturbing the flow of the coating composition within the die are, in fact, not introduced. High quality coatings with good uniformity cross-web and down-web, and no band-type defects of any kind, can be made from a wide variety of particulate-laden coating compositions using center-fed single cavity slot dies by employing the teachings of this disclosure.

The invention will now be described with reference to the Drawing. FIG. 1 is a schematic cut-away side view of a center-fed single cavity slot die 100 having a flow obstruction device of the invention. Single cavity slot die 100 has top die portion 101 and bottom die portion 103. When assembled together, top die portion 101 and bottom die portion 103 create a die cavity 105, and optionally (as shown) a die coating slot 106. A means for spacing 104 can be employed to adjust the coating slot height 107, making the die versatile with respect to the ability to make coatings of different select thicknesses. In an illustrative embodiment, the means for spacing 104 can be one or more shims, particularly precision ground shims as known in the art for making such cavity-slot dies more versatile. As will be understood by those skilled in the art, other means for spacing may be employed in the invention.

The particular sizes and shapes of top die portion 101, bottom die portion 103, die cavity 105, and die coating slot 106 are not limited, and may be readily determined by one skilled in the art of die design to accommodate the properties of the coating composition and the desired coating application in accordance with the invention.

Feed inlet 108 is provided so that coating solution can be delivered into the die cavity 105. The feed inlet has a feed inlet flow direction 110 (from left to right in FIG. 1). The feed inlet 108 has a feed inlet diameter 111 in the plane orthogonal to the feed inlet flow direction 110. Die cavity 105 has a die cavity height 112 that varies along the feed inlet flow direction 110. It may be advantageous for the die cavity height 112 to be greatest at a point relatively near to the feed inlet 108, but this is not required.

Inside die cavity 105, a flow obstruction device 109 is shown. The flow obstruction device 109 comprises a support member 113 and a deflector member 114. The support member is affixed to the bottom die portion at an affixing point 115. The affixing point 115 may be on the portion of the surface of the bottom die portion 103 that partially defines the die cavity 105. Any means of affixing the support member 113 to the bottom die portion 103 may be used. For example, a hole may be tapped into the surface of bottom die portion 103, and a peg may be provided on the bottom of support member 113 that will mate to the hole. Alternatively, support member 113 may be welded to bottom die portion 103. Other means may be used in accordance with the invention. The deflector member 114 is affixed to the support member 113 such that it is on the side of the support member 113 that faces the feed inlet 108. Deflector member 114 may be affixed to support member 113 in any manner, including welding, gluing, and the like, and also including fabrication as a unitary construction. The deflector member 114 may be positioned so that its bottom edge makes contact with the bottom die portion 103. Doing so ensures that there is no flow of the coating solution below the deflector member 114, which may be advantageous. The surface of bottom die portion 113 at the location of deflector member 114 may be slanted, or even curved (as shown), so it may be advantageous to machine the bottom edge of deflector member 114 so that it fits flush, or more nearly so, to the surface of bottom die portion 103. A clearance amount 119 is provided between the top of deflector member 114 and the surface of top die portion 101, in order to facilitate assembly of the die without risk of interference between the parts which might potentially result in gouging or other damage. The clearance amount should be kept as small as is practical, in order to minimize flow of the coating solution over the top edge of deflector member 114. In some embodiments, a clearance amount 119 of up to about 3 mils may be advantageous. In some embodiments, a clearance amount 119 of up to about 1 mil may be advantageous.

Figure 2:
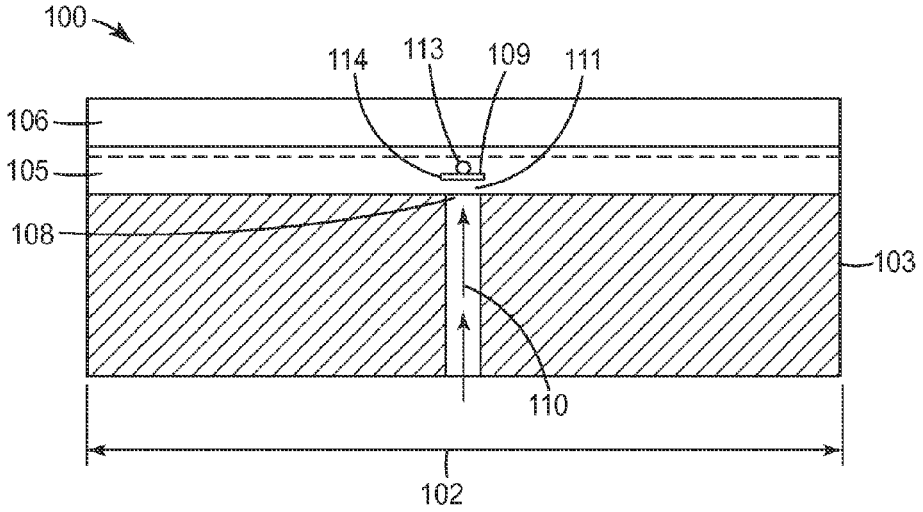
FIG. 2 is a schematic cut-away top view of a center-fed single cavity slot die having a flow obstruction device.

FIG. 2 is a schematic cut-away top view of a center-fed single cavity slot die 100 having a flow obstruction device of this invention. In this figure, the top die portion 101 has been removed, and the viewer is looking down on the bottom die portion 103. The die width 102 is shown. The feed inlet 108 is indicated, as is the feed inlet flow direction 110. The die cavity 105 now appears from this perspective as a horizontal band, as does the coating slot 106. The flow obstruction device 109 is seen from directly above, positioned within the die cavity 105. The feed inlet 108, the support member 113, the deflector member 114, and the affixing point 115 (not visible from this perspective) are all centered along the die width 102. Thus, the flow obstruction device 109 is centered in the flow from the feed inlet 108. In the embodiment shown in FIG. 2, deflector member 114 is slightly wider than the feed inlet diameter 111. The deflector member 114 shown in FIG. 2 is planar, in other embodiments non-planar deflector members may be used, and will be discussed further, below. Any deflector member 114 will have a planar profile when projected onto a plane orthogonal to the feed inlet flow direction 110. We have found via experimentation that this profile should be a rectangular profile, though the corners of the rectangle may be advantageously rounded. Profile shapes that are far from rectangular, such as circles and ovals, have been found to provide inferior performance. We have found via experimentation that the deflector member's planar profile should have a width that is from about ⅔ to about 4/3 of the feed inlet diameter 111. When the profile width is smaller than ⅔ of the feed inlet diameter 111, the center banding phenomenon is not effectively eliminated. When the profile width is larger than 4/3 of the feed inlet diameter 111, flow disturbances are set up at the lateral edges of the deflector member 114, and two bands, one on either side of the center line, are created in which the coating is depleted in terms of particulate matter with respect to the rest of the coating. A profile width that is equal or nearly equal to the feed inlet diameter 111 may provide the best performance. Experiments were performed using two dies, one having a feed inlet diameter 111 of ¾ inch (19 millimeters), and another having a feed inlet diameter 111 of ½ inch (13 millimeters). In both sets of experiments, the behavior transitions at planar profile width of ⅔ of the feed inlet diameter, and 4/3 of the feed inlet diameter, were observed.

Figure 3A:
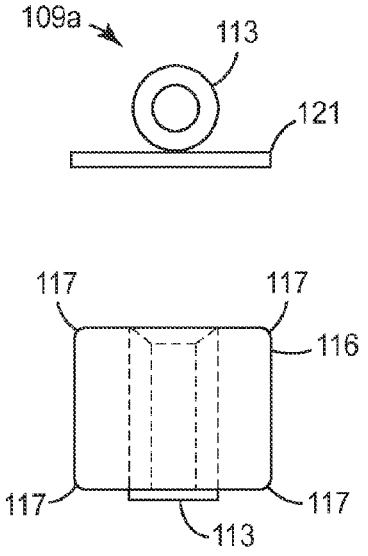
FIG. 3A is a schematic top view and a front view of a planar flow obstruction device having optional rounded corners.
Figure 3B:
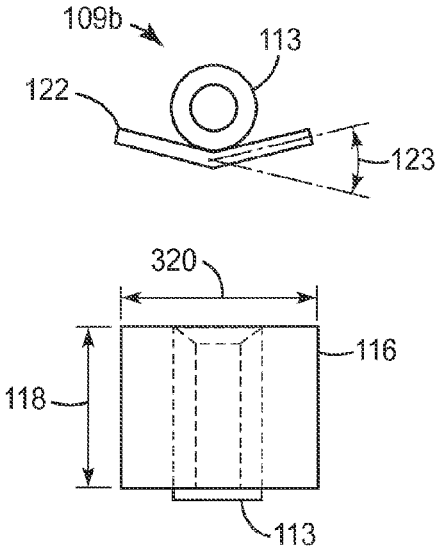
FIG. 3B is a schematic top view and a front view of a non-planar flow obstruction device.

FIGS. 3A and 3B depict schematically two possible flow obstruction devices 109*a* and 109*b*. In FIG. 3A, flow obstruction device 109*a* comprises support member 113 and a planar deflector member 121. The top illustration is the view from above, similar to the perspective of FIG. 2. The bottom illustration is the view from the feed inlet 108 (not shown), so it is a perspective orthogonal to both the perspective of FIG. 1 and the perspective of FIG. 2. Support member 113 is depicted as a hollow cylindrical rod, but this shape is not required. Support member 113 may be a solid cylindrical rod, or it may have a square cross-section, either solid or hollow. Illustrative examples include an I-beam shape or a T-bar shape; as will be understood by those skilled in the art other shapes may be used as well. In the bottom illustration, support member 113 is depicted as extending below the bottom of the rectangular profile 116 of the deflector member. This is not required, but would be the case if the support member were affixed to the bottom die portion 103 (not shown) by a peg-in-hole means of attachment, as discussed above. The rectangular profile 116 in FIG. 3A is provided with the optional rounded corners 117.

FIG. 3B depicts one possible non-planar deflection member 122. This non-planar deflection member 122 is shaped or bent at an angle 123 from the planar configuration shown in FIG. 3A. It may be advantageous for the bend to be oriented as shown in the figure, with the apex of the bend to be closer to the feed inlet 108 (not shown), so that the non-planar deflector member 122 can be said to taper away in the direction of flow rather than being cupped toward the direction of flow. It is typically preferred that the bend, if present, is symmetrical with respect to the flow direction. Typically, angle 123 is from about 10° to about 40°, in some embodiments from about 20° to about 30°. It has been observed, particularly when coating relatively higher viscosity coating compositions in accordance with the invention, that if the angle 123 is too large that the flow of coating composition may not fully rejoin after passing the deflection member resulting in thinned or open streaks in the resultant coating.

The bottom illustration of FIG. 3B depicts a similarly-configured support member 113 as that shown in FIG. 3A. Rectangular profile 116, however, is depicted without optional rounded corners 117. The height 118 may be smaller than the die cavity height112 at the affixing point 115. The height 118 may be smaller than the die cavity height 112 at the affixing point 115 by no more than a clearance amount 119. Clearance amount 119 is discussed in more detail, above. Rectangular profile 116 is shown with a width 120. As discussed above, width 120 is typically from about ⅔ to about 4/3 of the feed inlet diameter 111. In accordance with the invention, the relative dimensions and configuration of the deflection member is selected such that, following its introduction from the inlet orifice and flow around the deflection member, the flow of coating composition has achieved desired stability and uniformity (i.e., banding of particles in the suspension has been reduced or eliminated).

Without wishing to be bound by any theory, it is believed that the flow obstruction device reduces or eliminates center banding by preventing higher-velocity straight-line flow from the feed inlet to the die coating slot along the center line of the die (with respect to the die width). Flow is diverted sideways around the flow obstruction device and returns to the centerline behind the flow obstruction device at a reduced speed. Minimal amounts of coating solution escape the lateral detour by moving over or under the obstruction. Exceeding an upper limit on the width of the obstruction creates a different coating defect by introducing turbulent recirculation at the lateral edges. Two narrow bands appear in the finished coating, separated by approximately the width of the deflector member's rectangular profile, which are depleted in particulate content compared to nominal. Failure to meet a lower limit on the width of the obstruction fails to eliminate center banding because it imperfectly restricts, rather than fully prevents, higher-velocity straight-line flow from the feed inlet to the die coating slot. Failure to prevent significant flow over or under the obstruction also leads to imperfect restriction on straight-line flow. Thus, the counter-intuitive step of placing an object having a non-rounded, non-streamlined rectangular profile in the flow field is, surprisingly, effective in eliminating center banding. Rounding the corners of the rectangular profile may slightly improve performance, but taking that rounding off to the extreme of turning the rectangular profile into an oval or even circular profile is, counter-intuitively, ineffective.

Other embodiments are possible and will be apparent to one of skill in the art, and the illustrative embodiments shown in the Figures are not meant to be limiting.

We have discovered via experimentation that a planar deflector member 121 may provide good performance for coating compositions containing particles of average effective diameter of from about 0.8 microns to about 9 microns. For suspensions containing larger particles, a non-planar deflector 122 may provide superior performance.

We have observed via experimentation that superior performance may be obtained if the support member 113 is affixed to the bottom die portion 103 at an affixing point 115 within the coating die cavity 105 that is closer to the feed inlet 108 than it is to the near end of the coating slot 106. Such a placement is depicted in FIG. 1. A placement too far away from the feed inlet 108 was observed to create a different coating defect—a center band which is deficient in concentration of particulate material, rather than having an overabundance of particles. We have observed via experimentation that superior performance may be obtained if the support member 113 is affixed to the bottom die portion 103 at an affixing point 115 within the coating die cavity 105 that is located where the die cavity height 112 is largest. Such a placement is also depicted in FIG. 1. A placement too near the feed inlet 108 was observed not to completely eliminate center banding Some trial and error experimentation with placement of the support member 113 with respect to distance from the feed inlet 108 may be required for a particular die design, especially if there is no well-defined deepest point in the die cavity 105 relatively near, but a non-zero distance from, the feed inlet 108.

The invention also provides a coating process. One step in the process is to providing a coating composition or liquid suspension comprising solvent, polymer soluble in that solvent, and a particulate component suspended in the dissolved polymer solution but insoluble in that solvent. Another step in the process is to feed the coating composition to the center-fed single cavity slot die 100 having a flow obstruction device 109 as disclosed herein. Another step in the process is to apply the coating composition to a substrate. In some embodiments, the coating process may be followed by one or more such subsequent operations as drying or curing the coated composition, contacting a member to the surface of the coated composition resultant from the coating operation, etc.

As will be understood, the invention may be used with many polymers, oligomers, and monomers. Selection of one or more polymers, oligomers, and monomers for a particular application will be largely dependent upon the properties necessary in the resultant coating for the intended application. Those skilled in the art will be able to readily select suitable materials. Illustrative examples include functional urethanes, acrylates, siloxanes, polyethers, etc., for instance urethane acrylates (e.g., hexafunctional aliphatic urethane acrylate such as EBECRYL® 8301 from Allnex), extemp triacrylate esters, cellulose acetate butyrate (e.g., CAB 381-20 from Eastman Chemical Company), acrylate monomer (e.g., ethoxylated 15 tr4imeylolpropane triacrylate such as SARTOMER® 9035 from Sartomer), difunctional alpha-hydroxy ketone (e.g., ESACURE® ONE from Lamberti S.p.A.), and polyether siloxane copolymer (e.g., TEGO® Glide 100 from Evonik Resource Efficiency GmbH).

Selection of solvent or combination of solvents will be dependent in part upon the polymer, oligomer, and monomer selection (i.e., the solvent or combinations of solvents must be suitable for dissolving the selected polymer, oligomer, and monomer). Suitable solvents can be readily selected by those skilled in the art. Illustrative examples include glycol ether (e.g., DOWANOL™ PM from Dow Chemical Company); ketones such as methyl ethyl ketone, isopropyl alcohol, etc.

We have determined experimentally that the particulate component of the coating composition is not particularly limited. Particulate materials may include nanoparticles, conventional powders, microspheres, and beads. Particulate materials may be spherical or have another regular and well characterized shape, or particulate materials may be irregular in shape.

We have determined experimentally that performance may be enhanced when the particulate component comprises particles that are smaller than about 25 microns in average effective diameter. Particles larger than about 25 microns average effective diameter may tend to settle out from the coating composition and cause visually apparent defects in the coating when used in a die with a flow obstruction device described herein. Good results with coating compositions having particles that are greater than about 0.8 microns in average effective diameter have been experimentally demonstrated Particulate materials are also not particularly limited as to chemical composition. Good results have been obtained using apparatus described herein for coating compositions bearing particles made of polystyrene, polypropylene, poly (methyl methacrylate), silica, and glass.

Viscosity of the coating solution is also not particularly limited. Good results may be obtained using solutions ranging in viscosity from about 1 cP (0.001 pascal·second) to about 1000 cP (1 pascal·second). We have observed particularly positive results using apparatus described herein when employing coating solutions having viscosities ranging from about 6 cP (0.006 pascal·second) to about 600 cP (0.6 pascal·second).

The concentration of the particulates in the suspension is limited only in that the composition must be a flowing liquid rather than merely coated particulates. It is possible to prepare coating compositions that contain up to about 70% particulate patter by volume. We have observed good results experimentally with the apparatus described herein while employing coating compositions with particulate content ranging from about 6% to about 68% by volume.

The coating slot height is limited only by the ability of a uniform coating flow to traverse the coating slot without agglomeration or deposition of particulate matter at the die exit. In typical embodiments, slot height will be from about 4 mils (0.1 millimeter) to about 8 mils (0.2 millimeter) with from about 5 mils (0.13 millimeter) to about 6 mils (0.15 millimeter) being an often suitable choice. Experimentally we have observed good results using the apparatus described herein when employing coating slot heights as small as about 4 mils.

Following are a list of illustrative embodiments of the present invention:

Embodiment 1: A single cavity slot die for coating particulate suspensions, comprising:

a top die portion having a die width, and a bottom die portion;

a means for spacing the top die portion and bottom die portion, when assembled, to form a coating die cavity and a die coating slot having a coating slot height;

a feed inlet in the bottom die portion centered along the die width for center-feeding the die cavity; and a flow obstruction device;

wherein the feed inlet has a feed inlet flow direction and a feed inlet diameter in the plane orthogonal to the feed inlet flow direction, and wherein the coating die cavity has a die cavity height which varies along the feed inlet flow direction, and wherein the flow obstruction device comprises a support member and a deflector member, the support member being affixed to the bottom die portion at an affixing point within the coating die cavity, the affixing point being centered along the die width, and the deflector member being affixed to the support member on the side facing the feed inlet, and centered along the die width, and wherein the deflector member has a rectangular profile, the rectangular profile optionally having rounded corners, in a plane orthogonal to the feed inlet flow direction, the rectangular profile having a height smaller than the die cavity height at the affixing point by no more than a clearance amount necessary to provide safe clearance when joining the top die portion to the bottom die portion when assembling the die, and having a width from about ⅔ to about 4/3 of the feed inlet diameter.

Embodiment 2: The die of Embodiment 1 wherein the means for spacing the top die portion and bottom die portion is one or more shims.

Embodiment 3: The die of Embodiment 1 wherein the deflector member is planar.

Embodiment 4: The die of Embodiment 1 wherein the deflector member is non-planar.

Embodiment 5: The die of Embodiment 4 wherein the deflector member is bent at the point of attachment to the support member, the direction of the bend being such that the point of attachment to the support member is the closest point on the deflector member to the feed inlet.

Embodiment 6: The die of Embodiment 5 wherein the deflector member is bent symmetrically.

Embodiment 7: The die of Embodiment 5 wherein the deflector member is bent at an angle of less than about 40°.

Embodiment 8: The die of Embodiment 5 wherein the deflector member is bent at an angle of less than about 30°.

Embodiment 9: The die of Embodiment 5 wherein the deflector member is bent at an angle of greater than about 10°.

Embodiment 10: The die of Embodiment 1 wherein the support member is affixed to the bottom die portion at an affixing point within the coating die cavity that is closer to the feed inlet than it is to the near end of the coating slot.

Embodiment 11: The die of Embodiment 1 wherein the support member is affixed to the bottom die portion at an affixing point within the coating die cavity that is located where the die cavity height is largest.

Embodiment 12: The die of Embodiment 1 wherein the clearance amount is no more than about 3 mils.

Embodiment 13: The die of Embodiment 1 wherein the clearance amount is no more than about 1 mil.

Embodiment 14: The die of Embodiment 1 wherein the rectangular profile has a width approximately equal to the feed inlet diameter.

Embodiment 15: A coating process, comprising the steps of:

providing a coating composition or liquid suspension comprising solvent, polymer soluble in that solvent, and a particulate component suspended in the dissolved polymer solution but insoluble in that solvent;

feeding the coating composition to the die of Embodiment 1; and applying the coating composition to a substrate.

Embodiment 16: The coating process of Embodiment 15 wherein the particulate component comprises beads.

Embodiment 17: The coating process of Embodiment 15 wherein the particulate component comprises nanoparticles.

Embodiment 18: The coating process of Embodiment 15 wherein the particulate component comprises particles that are irregular in shape.

Embodiment 19: The coating process of Embodiment 15 wherein the particulate component comprises particles that are smaller than about 25 microns in average effective diameter.

Embodiment 20: The coating process of Embodiment 15 wherein the particulate component comprises particles that are greater than about 0.8 microns in average effective diameter.

Embodiment 21: The coating process of Embodiment 15 wherein the particulate component is selected from the group consisting of polystyrene, polypropylene, poly(methyl methacrylate), silica, and glass.

Embodiment 22: The coating process of Embodiment 15 wherein the coating composition has a viscosity of from about 1 cp to about 1000 cp.

Embodiment 23: The coating process of Embodiment 15 wherein the coating composition has a viscosity of from about 6 cp to about 600 cp.

Embodiment 24: The coating process of Embodiment 15 wherein the coating composition comprises no more than about 70% by volume of the particulate component.

Embodiment 25: The coating process of Embodiment 15 wherein the coating composition comprises from about 6% to about 68% by volume of the particulate component.

Embodiment 26: The coating process of Embodiment 15 wherein die coating slot has a coating slot height of at least about 4 mils.

Unless otherwise indicated, all numbers expressing feature sizes, amounts, and physical properties used in the specification and claims are to be understood as being modified by the term "about". Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this application, except to the extent they may directly contradict this application. Although specific embodiments have been illustrated and described herein, it will be appreciated by those of ordinary skill in the art that a variety of alternate and/or equivalent implementations can be substituted for the specific embodiments shown and described without departing from the scope of the present invention. This application is intended to cover any adaptations or variations of the specific embodiments discussed herein.

What is claimed is:

1. A single cavity slot die for coating particulate suspensions comprising:

a top die portion having a die width, and a bottom die portion;

a means for spacing the top die portion and the bottom die portion, when assembled, to form a coating die cavity and a die coating slot having a coating slot height;

a feed inlet in the bottom die portion centered along the die width for center-feeding the coating die cavity; and a flow obstruction device;

wherein the feed inlet has a feed inlet flow direction and a feed inlet diameter in a plane orthogonal to the feed inlet flow direction, and wherein the coating die cavity has a die cavity height which varies along the feed inlet flow direction, and wherein the flow obstruction device comprises a support member and a deflector member, the support member being affixed to the bottom die portion at an affixing point within the coating die cavity, the affixing point being centered along the die width, and the deflector member being affixed to the support member on a side facing the feed inlet, and centered along the die width, and wherein the deflector member has a rectangular profile when projected onto a plane orthogonal to the feed inlet flow direction, the rectangular profile having square corners or rounded corners, the rectangular profile having a height smaller than the die cavity height at the affixing point by no more than a clearance amount necessary to provide clearance when joining the top die portion to the bottom die portion when assembling the single cavity slot die, and having a width between ⅔ and 4/3 of the feed inlet diameter.

2. The single cavity slot die of claim 1, wherein the means for spacing the top die portion and the bottom die portion is one or more shims.

3. The single cavity slot die of claim 1, wherein the deflector member is planar.

4. The single cavity slot die of claim 1, wherein the deflector member is non-planar.

5. The single cavity slot die of claim 4, wherein the deflector member is bent to form a bend at a point of attachment to the support member, a direction of the bend being such that the point of attachment to the support member is a closest point on the deflector member to the feed inlet.

6. The single cavity slot die of claim 5, wherein the deflector member is bent symmetrically.

7. The single cavity slot die of claim 5, wherein the deflector member is bent at an angle of less than about 40 °.

8. The single cavity slot die of claim 5, wherein the deflector member is bent at an angle of less than about 30 °.

9. The single cavity slot die of claim 5, wherein the deflector member is bent at an angle of greater than about 10 °.

10. The single cavity slot die of claim 1, wherein the support member is affixed to the bottom die portion at the affixing point within the coating die cavity, wherein the affixing point is closer to the feed inlet than it is to an end of the die coating slot.

11. The single cavity slot die of claim 1, wherein the support member is affixed to the bottom die portion at the affixing point within the coating die cavity, wherein the affixing point is located where the coating die cavity height is largest.

12. The single cavity slot die of claim 1, wherein the clearance amount is no more than about 3 mils.

13. The single cavity slot die of claim 1, wherein the clearance amount is no more than about 1 mil.

14. The single cavity slot die of claim 1, wherein the rectangular profile has a width approximately equal to the feed inlet diameter.

15. A coating process comprising steps of:

providing a coating composition comprising a solvent, a polymer soluble in the solvent, and a particulate component suspended in a dissolved polymer solution comprising the polymer but insoluble in the solvent;

feeding the coating composition to a single cavity slot die for coating particulate suspensions comprising:

a top die portion having a die width, and a bottom die portion;

a means for spacing the top die portion and the bottom die portion, when assembled, to form a coating die cavity and a die coating slot having a coating slot height;

a feed inlet in the bottom die portion centered along the die width for center-feeding the coating die cavity; and a flow obstruction device;

wherein the feed inlet has a feed inlet flow direction and a feed inlet diameter in a plane orthogonal to the feed inlet flow direction, and wherein the coating die cavity has a die cavity height which varies along the feed inlet flow direction, and wherein the flow obstruction device comprises a support member and a deflector member, the support member being affixed to the bottom die portion at an affixing point within the coating die cavity, the affixing point being centered along the die width, and the deflector member being affixed to the support member on a side facing the feed inlet, and centered along the die width, and wherein the deflector member has a rectangular profile when projected onto a plane orthogonal to the feed inlet flow direction, the rectangular profile having square corners or rounded corners, the rectangular profile having a height smaller than the die cavity height at the affixing point by no more than a clearance amount necessary to provide clearance when joining the top die portion to the bottom die portion when assembling the single cavity slot die, and having a width between ⅔ and 4/3 of the feed inlet diameter; and applying the coating composition to a substrate.

16. The coating process of claim 15, wherein the particulate component comprises beads.

17. The coating process of claim 15, wherein the particulate component comprises nanoparticles.

18. The coating process of claim 15, wherein the particulate component comprises particles that are irregular in shape.

19. The coating process of claim 15, wherein the particulate component comprises particles that are smaller than about 25 microns in average effective diameter.

20. The coating process of claim 15, wherein the particulate component comprises particles that are greater than about 0.8 microns in average effective diameter.

21. The coating process of claim 15, wherein the particulate component is selected from a group consisting of polystyrene, polypropylene, poly(methyl methacrylate), silica and glass.

22. The coating process of claim 15, wherein the coating composition has a viscosity of from about 1 centipoise to about 1000 centipoise.

23. The coating process of claim 15, wherein the coating composition has a viscosity of from about 6 centipoise to about 600 centipoise.

24. The coating process of claim 15, wherein the coating composition comprises no more than about 70% by volume of the particulate component.

25. The coating process of claim 15, wherein the coating composition comprises from about 6% to about 68% by volume of the particulate component.

26. The coating process of claim 15, wherein the die coating slot has a coating slot height of at least about 4 mils.

* * * * *